United States Patent [19]

Sakitani et al.

[11] Patent Number: 4,840,043

[45] Date of Patent: Jun. 20, 1989

[54] CRYOGENIC REFRIGERATOR

[76] Inventors: Katsumi Sakitani; Yoon M. Kang; Shinichiro Shinozaki; Shoichi Taneya; Kazuo Miura; Tadashi Ogura; Satoshi Noguchi, all of c/o Kanaoka Factory, Sakai Plant, Daikin Industries, Ltd., 1304 Kanaoka-cho, Sakai-shi, Osaka 591, Japan

[21] Appl. No.: 50,475

[22] Filed: May 18, 1987

[30] Foreign Application Priority Data

May 16, 1986 [JP] Japan ..... 61-113332
May 16, 1986 [JP] Japan ..... 61-113333

[51] Int. Cl.[4] ..... F25B 19/00
[52] U.S. Cl. ..... 62/51.2; 250/352
[58] Field of Search ..... 62/514 R, 37; 250/352

[56] References Cited

U.S. PATENT DOCUMENTS

| | | | |
|---|---|---|---|
| 4,048,814 | 9/1977 | Quack | 62/514 R |
| 4,189,930 | 2/1980 | Davydov et al. | 62/514 R |
| 4,209,657 | 6/1980 | Inai et al. | 62/514 R |
| 4,223,540 | 9/1980 | Longsworth | 62/514 R |
| 4,242,885 | 1/1981 | Quack et al. | 62/514 R |
| 4,366,680 | 1/1983 | Twaro | 62/514 R |
| 4,432,216 | 2/1984 | Matsuda et al. | 62/514 R |
| 4,498,313 | 2/1985 | Hosoyama et al. | 62/514 R |
| 4,510,771 | 4/1985 | Matsuda et al. | 62/514 R |

*Primary Examiner*—Ronald C. Capossela
*Attorney, Agent, or Firm*—Wenderoth, Lind & Ponack

[57] ABSTRACT

In a cryogenic refrigerator having a precooling refrigerating circuit including a cryostat for cooling and maintaining a cryogenic working apparatus which is operated at a very low temperature level, an expander for expanding refrigerant gas, such as helium gas, and a J-T circuit for generating cold by Joule-Thomson expanding refrigerant gas precooled by the precooling refrigerating circuit, the present invention prevents the working vibration of the expander from unduly effecting the cryogenic working apparatus and to maintain the cryogenic working apparatus at a very low temperature level for many hours, even while the precooling refrigerating circuit is stopped thereby enabling a stabilized operation of the cryogenic working apparatus to be performed.

11 Claims, 8 Drawing Sheets

A
B
C
C1
C2
S
1
2
3
4
5
6
7
7a
7b
8
9
10
11
12
13
20
21
22
23
24
25
26
27
28
29
30
31
32
33
34
35
36
37
40
41
42
43
44
45
46
47
48
50
51
52
53
54
56
60

A
B
C
C1
C2
S
1
2
3
4
5
6
7
7a
7b
8
9
10
11
12
13
20
21
22
23
24
25
26
27
28
29
30
31
32
33
34
35
36
37
40
41
42
43
44
45
46
47
48
49
55
60
61

CRYOGENIC REFRIGERATOR

BACKGROUND OF THE INVENTION

1. Field of the Invention:

This invention relates to a cryogenic refrigerator having a dual circuit comprising a precooling refrigerating circuit for expanding refrigerant gas, such as helium gas, and a J-T (Joule-Thomson) circuit, in which a cryogenic working apparatus is maintained at a very low temperature level by generating cold at a cryogenic level maintaining part in a cryostat (cryogenic tank), and in particular to a measure for reducing vibration while a cryogenic working apparatus is used.

2. Description of the Prior Art:

As disclosed in U.S. Pat. No. 4,223,540, a helium refrigerator is well known as a very low temperature refrigerator. This helium refrigerator is provided with a precooling refrigerating circuit, whereby a cryogenic maintaining part in a cryostat is radiantly shielded from the outside by expanding high pressure helium gas by an expander, and a J-T circuit whereby compressed helium gas discharged from another compressor is precooled in said precooling refrigerating circuit and such precooled helium gas is then Joule-Thomson expanded at a J-T valve to generate cold in the cryogenic level maintaining part of the cryostat by expanding action at that time. In such a helium refrigerator as mentioned above the G-M cycle (Gifford-MacMahon cycle), the modified Solvay cycle or the like is generally employed as a refrigerating cycle produced by a precooling refrigerating circuit. In this case, it is inevitable that vibration is generated due to a change of pressure in gas flowing at an expander, collision of a displacer with a cylinder, expansion and shrinkage of a cylinder due to change of pressure (high pressure/low pressure), etc. Thus, it was difficult to use such cycles in a system using a photo-detecting sensor to be used in spectrochemical study where micro vibration in the order of $\mu$m must be avoided. Therefore, when using such a photo-detecting sensor, the operation of the refrigerator is stopped and measuring is finished by utilizing thermal capacity at a sensor part and at a heat station before the temperature at the sensor part rises beyond the temperature required for cooling the sensor part. However, the stoppage of a refrigerator during the operation of a sensor causes the following problems.

When a refrigerator is working, helium gas feeding pressure and return pressure are maintained at about 20 atm, and 1 atm respectively, and helium gas which passed through a J-T valve is partly liquefied and is maintained at a very low temperature level of about 4 K. However, as soon as the refrigerator is stopped, pressure in the J-T circuit is balanced at about 8 atm and as shown in FIG. 11 liquid helium at the sensor part reaches a supercritical pressure in a moment and its temperature rises to 5.5–8 K.

Generally, when a very low temperature level is reached, thermal capacity at each part becomes small due to small specific heat and even the slightest thermal load causes an abrupt rise in temperature.

Therefore, in the sensor which utilizes the phenomenon of super conductivity or which is reduced in low heat noise, the sensor temperature rises abruptly and as a result, problems such as the breaking down of the superconductivity, the difficulty in measuring due to the increase of heat noise, etc., are raised.

SUMMARY OF THE INVENTION

The main object of the present invention is to increase by a large margin the length of time during which a cryogenic working apparatus is kept at a very low temperature level and thereby enable measuring to be carried out stably for a very low temperature refrigerator, such as a helium refrigerator, having a dual circuit comprising a precooling refrigerator circuit and a J-T circuit.

In order to attain the above-described object, the present invention provides a precooling refrigerating circuit working stop means for stopping the operation of the precooling refrigerating circuit and a control means for stopping the operation of the precooling refrigerating circuit by activating the precooling refrigerating circuit working stop means and for continuing the operation of the J-T circuit, when the cryogenic working apparatus is working, in a cryogenic refrigerator equipped with a cryostat having a cryogenic maintaining part for keeping cold the cryogenic working apparatus which is operated at a very low temperature level, a precooling refrigerating circuit in which refrigerant gas compressed by a compressor is expanded to generate cold and to keep the cold at a heat station, and a J-T circuit in which high pressure refrigerant gas from a compressor undergoes heat exchange and is precooled at the heat station of the precooling refrigerating circuit and such precooled refrigerant gas is Joule-Thomson expanded to generate cold in the cryogenic level maintaining part of the cryostat.

In the above-described refrigerator, there is a fear that the J-T circuit is working, the amount of heat emanating from the precooling refrigerating circuit increases due to the usual flow of refrigerant gas in the J-T heat exchanger and accordingly, the temperature rise on the precooling refrigerating circuit side occurs faster and the normal precooling capacity return of the precooling refrigerating circuit at the re-start of the operation thereof after stoppage of the cryogenic working apparatus is delayed.

From the above, an object of the present invention is, in the J-T circuit which is operated continuously when the above-mentioned cryogenic working apparatus is operating, to improve the starting characteristic of precooling capacity at the re-start of the operation of the precooling refrigerating circuit by checking the flow of refrigerant in the J-T heat exchanger.

For achieving this object, the present invention is provided with a bypass means for bypassing refrigerant gas in the high pressure side piping of the J-T circuit to a low pressure side piping and a pressure regulating means for decompressing refrigerant gas in the high pressure side piping to the pressure of refrigerant gas in the low pressure side piping (1 atm, for example), whereby the working of the precooling refrigerating circuit is stopped when the cryogenic working apparatus is operating and the bypass means and the pressure regulating means are activated.

However, when refrigerant does not flow to the J-T circuit side, it is difficult to maintain a very low temperature level. For example, it is disadvantageous when the thermal load during a cooling stage is large, namely, when there is a radiant thermal load, heat enters from a measuring line, etc., in the optical measuring instrument.

In view of the above, the present invention has for one of its objects to maintain the temperature level of the cooling stage at the desired temperature by keeping the flux of refrigerant at the J-T circuit large, even when the cryogenic working apparatus is working.

For achieving this object, the present invention is provided with an expander stop means to stop the operation of an expander of the precooling refrigerating circuit and a control means to activate the expander stop means when the cryogenic working apparatus is operating.

The bypass system through which refrigerant is bypassed to the J-T heat exchanger in the J-T circuit when the cryogenic operating apparatus is working as stated above and the non-bypass system in which a bypass is not carried out, have their own features.

For example, in the bypass system, refrigerant does not flow to the heat-exchanger of the J-T circuit when the cryogenic working apparatus is working and therefore this system can check a temperature rise therein by reducing movement of cold heat from the precooling refrigerating circuit and can perform a precooling function quickly at the re-start of the precooling refrigerating circuit. Therefore, this system is especially advantageous when the thermal load at the cooling stage is small and the measuring by the cryogenic working apparatus is carried out in a short time.

On the other hand, in the non-bypass system refrigerant flows to the J-T circuit in abundant quantities and therefore its very low temperature level can be maintained satisfactorily. Accordingly, this system is advantageous when the thermal load at the cooling stage is large due to radiant heat load, entering heat, etc.

According to the present invention, it is possible for a very low temperature refrigerator having a J-T circuit for generating cold in the cryostat for keeping a cryogenic working apparatus in a cooled state by Joule-Thomson expanding high pressure refrigerant gas and a precooling refrigerating circuit for precooling refrigerant gas at the J-T circuit, to maintain a cryogenic working apparatus which is sensitive to vibration in a very low temperature state for many hours and thereby stabilize its operation by eliminating vibration due to the operation of the expander by stopping the operation of the precooling refrigerating circuit and by continuing the operation of the J-T circuit when the cryogenic working apparatus is operating and also by eliminating an abrupt rise in temperature by checking the rise of pressure of refrigerant gas at the working apparatus part.

According to the present invention, by stopping the operation of the precooling refrigerating circuit when the cryogenic working apparatus is, and by decompressing refrigerant gas in the high pressure side piping to the pressure of refrigerant gas in the low pressure side piping, it becomes possible to perform the precooling function quickly at the re-start of the precooling refrigerating circuit because refrigerant does not flow in the heat exchanger of the J-T circuit and the temperature rise of the heat exchanger can be restricted. The present invention is especially advantageous when the thermal load of the cooling stage is small and the measuring by the cryogenic working apparatus is carried out in a short time.

Furthermore, according to the present invention, when the cryogenic working apparatus is operating, the operation of the expander at the precooling refrigerating circuit is stopped and therefore the very low temperature level can be maintained satisfactorily by causing refrigerant fully in the J-T circuit. The present invention to flow is especially advantageous when the thermal load produced during the cooling stage is large.

BRIEF DESCRIPTION OF THE DRAWING

FIG. 1–FIG. 8 show preferred embodiments of the present invention, in which FIG. 1 shows a helium refrigerator according to the first embodiment;

FIG. 2 is a characteristic drawing showing temperature rising characteristics at a sensor part when a photo-detecting sensor is operating;

FIG. 3 shows a second embodiment of the present invention; FIG. 4 is a drawing corresponding to FIG. 2;

FIG. 5 is a characteristic drawing illustrating the working cycle of the precooling refrigerating circuit;

FIG. 6 shows a third embodiment of the present invention;

FIG. 7 shows as a whole the fourth embodiment as a whole;

FIG. 8 shows the fifth embodiment as a whole;

DETAILED DESCRIPTION OF THE PREFERRED EMBODIMENTS

Preferred embodiments of the present invention are described below with reference to the drawings.

Figure 1:
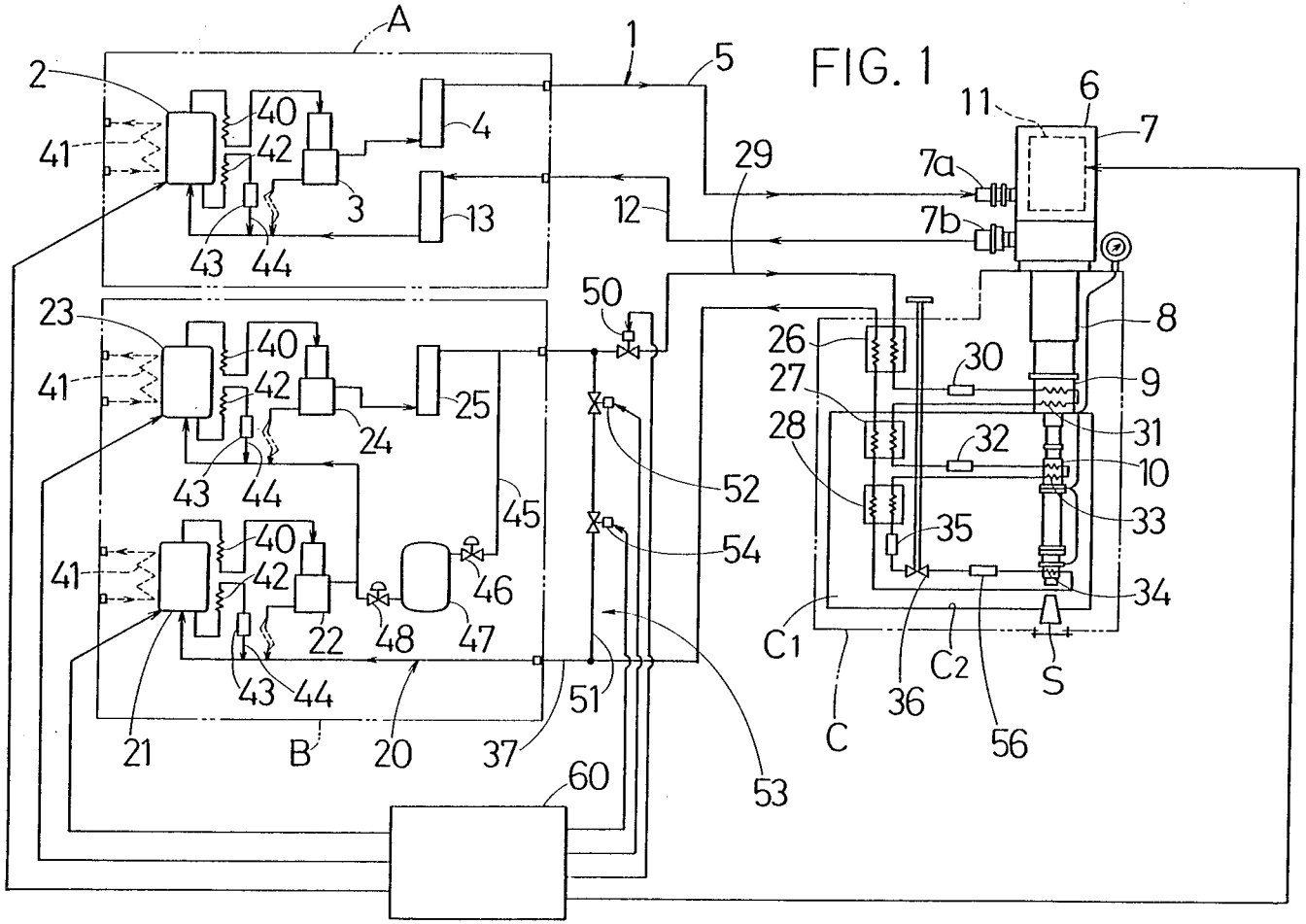

FIG. 1 shows of a helium refrigerator having a dual two-stage compression cycle according to the first embodiment of the present invention. Symbol C designates a cryostat having a cryogenic maintaining part $C_1$ therein which keeps a photo-detecting sensor S for facilitating spectrochemical study in a cooled state. Numeral 1 designates a precooling refrigerating circuit for producing a modified Solvay gas cycle in which helium gas for precooling helium gas is compressed and expanded in a J-T circuit 20 (to be described next). Numeral 20 designates a J-T circuit which compresses and Joule-Thomson expands helium gas for generating a very low temperature level. The above-mentioned precooling refrigerating circuit 1 and the J-T circuit 20 are arranged in a row, the former extending from a compressor unit for precooling A to the cryostat C and the latter extending from a compressor unit on J-T side B to the cryostat C.

The above-mentioned compressor unit for precooling A is provided with a compressor 2 for precooling which compresses helium gas, an oil separator 3 which separates lubricating oil for the compressor 2 from high pressure helium gas compressed by the compressor 2 and an adsorber 4 which adsorbs and removes water, impure gas, etc. in helium gas which has passed through the oil separator 3. The adsorber 4 is connected to a high pressure side entrance 7*a* of a casing 7 of an expander 6 fitted to the cryostat C, via high pressure side piping 5.

The casing 7 is disposed outside the cryostat C and a cylinder 8 is connected to the lower part of the casing 7. Provided at the outer circumference of the cylinder 8 are a second heat station 10 and a first heat station 9, both disposed in the cryogenic maintaining part $C_1$.

Fitted in the casing 7 are a rotary valve (not shown in the drawing) which opens at every rotation to feed helium gas flowing from the high pressure side entrance 7*a* into the cylinder 8 and a valve motor 11 which drives said rotary valve. Although not shown in the drawing, fitted in the cylinder 8 are a slack piston which reciprocates according to the opening and shutting of the rotary valve and a displacer which reciprocates in the cylinder 8 by being engaged with and driven by the slack piston and which Simon expands helium gas. The first station 9 of the cylinder 8 is thermally connected with a radiant shield part $C_2$ which is arranged in such a fashion that it encloses the low temperature level maintaining part $C_1$ in the cryostat C. In this arrangement, high pressure helium gas is expanded in the cylinder by opening the rotary valve of the expander 6 to generate the low temperature state, which is maintained at the first and the stations 9, 10 in the cylinder 8, and to cool down to a low temperature the radiant shield part $C_2$ which is in thermal contact with the first heat station 9 so as to radiantly shield the cryogenic maintaining part $C_1$ from the outside.

A low pressure side exit 7*b* for discharging low pressure helium after expansion is open to the casing 7 of the expander 6. The low pressure side exit 7*b* is connected to a surge bottle 13 provided at the compressor unit for precooling A, via low pressure side piping 12. The surge bottle 13 is connected to the intake side of the compressor for precooling 2. Low pressure helium gas discharged from the expander 6 is absorbed by the surge bottle 13 and sucked in by the compressor 2. Thus, high pressure helium gas discharged from the compressor 2 for precooling is fed to the expander 6, via the oil separator 3 and the adsorber 4, and due to the adiabatic expansion at the expander 6, the temperature of the heat stations 9, 10 is lowered, whereby the cryogenic maintaining part $C_1$ in the cryostat C is radiantly shielded, coolers 31, 33 (to be described later) at the J-T circuit 20 are cooled, and expanded low pressure helium gas is returned to the compressor 2 for recompression, via the surge bottle 13.

Provided at the J-T side compressor unit B are a low stage compressor 21 for compressing helium gas to a specified pressure, an oil separator 22 for separating and removing lubricating oil for the compressor 21 from high pressure helium gas discharged from the compressor 21, a high stage compressor 23 for compressing high pressure helium gas which has passed through the oil separator to a still higher pressure, an oil separator 24 for separating and removing lubricating oil for the compressor 23 from high pressure helium gas discharged from the compressor 23 and an adsorber 25 for adsorbing and removing impurities in the high pressure helium gas which has passed through the oil separator 24.

Fitted in the cryostat C are first, second and third J-T heat exchangers 26, 27, 28 for facilitating heat exchange between helium gas passing through the primary side and the secondary side. Of these J-T heat exchangers 26, 27, 28, the second and the third J-T heat exchangers 27, 28 are arranged in the radiant shield part $C_2$ of the cryostat C. The primary side of the first J-T heat exchanger 26 is connected to the adsorber 25 of the J-T side compressor unit B, via the high pressure side piping 29. The primary sides of the first and the second J-T heat exchangers 26, 27 are connected to each other, via an adsorber 30 and a first precooler 31 disposed at the outer circumference of the first station 7 of the expander 6. The primary sides of the second and the third J-T heat exchangers, 27, 28 are connected to each other via an adsorber 32 and a second precooler 33 arranged at the outer circumference of the second heat station 8. The primary side of the third J-T heat exchanger 28 is connected to a cooler 34, which is supported at the lower end of the cylinder 8 of the expander 6 and is located in the low temperature level maintaining part $C_1$, via an adsorber 35 and a J-T valve 36 which Joule-Thomson expands high pressure helium gas. The cooler 34 is connected to the secondary side of the first J-T heat exchanger 26 via the secondary sides of the third and the second J-T heat exchangers 28, 27. The secondary side of the first J-T heat exchanger 26 is connected to the intake side of the low stage compressor 21 in the J-T side compressor unit B, via a low pressure side piping 37. In this arrangement, helium gas is compressed to have a high pressure by two compressors 21, 23 connected in two-stage series and is fed to the cryostat C side. The high pressure helium gas undergoes heat exchange at the first, second and third J-T heat exchangers 26, 27, 28, with low temperature/low pressure helium gas returning to the J-T side compressor unit B, further undergoes heat exchange at the first and the second coolers 31, 33 with the first and the second stations 9, 10 and is cooled, is Joule-Thomson expanded by a J-T valve 36 to a pressure and temperature of 1 atm and about 4 K. at the cooler 34. Then, the helium which has been made to have a low pressure is drawn into the low stage compresser 21 of the J-T side compressor unit B, passing through the secondary sides of the first, second and third J-T heat exchangers 26, 27, 28, for recompression.

The compressor 2 of the compressor unit for precooling A and two compressors 21, 23 of the J-T side compressor unit B, together with surrounding apparatuses, are of similar construction. In the drawing, numeral 40 designates discharge gas coils arranged along a flow path from the discharge side of compressors 2, 21, 23 to the oil separators 3, 22, 24. These discharge gas coils 40 are wound around the upper half of the outer circumference of the casing of each compressor 2, 21, 23. Wound around the entire outer circumference of the casing of each compressor 2, 21, 23 and along the discharge gas coils 40 are cooling water coils 41 in which cooling water runs. Due to the cooling water which runs in the cooling water coils 41, high temperature/high pressure helium gas which was discharged from the compressors 2, 21, 23 and is flowing in the discharge gas coils 40 is cooled down.

Numeral 42 designates oil coils which are wound around, along the cooling water coils 41, the lower half of the outer circumferential surface of the casing of each compressor 2, 21, 23. The upstream ends of the oil coils 42 are connected to the oil tank at the inner bottom part of the casing of each compressor 2, 21, 23 and the downstream ends are connected to the intake side of each compressor 2, 21, 23 via orifices 43 and injection pipes 44. Lubricating oil in the casing to be discharged, together with helium gas, from each compressor 2, 21, 23 is fed to the oil coils 42 and is cooled down with cooling water in the cooling water coils 41 and then is injected in inhaled helium gas by the orifices 43 of the injection pipes 44.

Numeral 45 designates a connecting pipe which connects the discharge side of the oil separator 22 of the J-T side compressor unit B with the discharge side of the adsorber 25. Arranged along this connecting pipe are a high pressure control valve 46 which decompresses the pressure of helium gas discharged from the compressor unit B, a gas ballast tank 47 to which high pressure helium gas flows from the high pressure control valve 46 and an intermediate pressure control valve 48 which feeds high pressure helium gas in the tank 47 to the discharge side of the oil separator 22 and controls the discharging pressure of the low stage compressor 21.

The characterizing features of the present invention are described below.

A first electromagnetic valve 50 which opens and shuts the high pressure side piping 29 is arranged along said high pressure side piping 29 of the J-T circuit 20. One end of bypass piping 51 is connected to the high pressure side piping 29 at the immediate upstream side of the first electromagnetic valve 50 and the other end of the bypass piping 51 is connected to the low pressure side piping 37. Along this bypass piping 51, a second electromagnetic valve 52 which opens and shuts said bypass piping 51 is provided. A bypass means 53 is so disposed that helium gas in the high pressure side piping 29 is bypassed to the low pressure side piping 37 via the bypass piping 51 when the high pressure side piping 29 is shut by closing the first electromagnetic valve 50 and by opening the bypass piping 51 by opening the second electromagnetic valve 52.

Provided at the bypass piping 51 which is immediately downstream of the second electromagnetic valve 52 is an electromagnetic constant pressure regulating valve 54 functioning as a pressure regulating means which, when the bypass means 53 is open, decompresses high pressure helium gas in the high pressure side piping 29 to the pressure of helium gas in the low pressure side piping 37, namely, to the pressure (1 atm, for example) corresponding to the required cooling temperature (4 K., for example) of the photo-detecting sensor S.

The compressor 2 and the expander 6 of the precooling refrigerating circuit 1, two compressors 21, 23 of the J-T circuit 20, the first and the second electromagnetic valves 50, 52 and the constant pressure regulating valve 54 are controlled by a control device 60. With this control device 60, when the photo-detecting sensor S is working (measuring), the compressor 2 and the expander 6 of the precooling refrigerating circuit 1 are stopped and accordingly, the operation of the precooling refrigerating circuit 1 itself is stopped. On the other hand, by opening the bypass means 53 and the constant pressure regulating valve 54 (pressure regulating means) helium gas in the high pressure side piping 29 is decompressed to a specified pressure by the constant pressure regulating valve 54 and is returned to the low pressure side piping 37.

In the J-T circuit 20, a liquid tank 56 which stores helium liquid is provided at piping between the J-T valve 36 and the cooler 34 for cooling the sensor.

The operation of the helium refrigerator of the above-described embodiment is made below.

While the photo-detecting sensor S in the cryostat C is not operating, the first electromagnetic valve 50 at the bypass means 53 is open but the second electromagnetic valve 52 is shut in a normal state. In this normal state, cooling at the photo-detecting sensor S is carried out. This action is explained below in detail.

When the compressor 2 of the precooling refrigerating circuit 1 and two compressors 21, 23 at the J-T circuit 20 are started and the refrigerator is in a normal operating state, high pressure helium gas fed from the compressor 2 is expanded by the expander 6 on the cryostat C side and due to this expansion of the gas, the temperature of each heat station 9, 10 of the cylinder 8 and the radiant shield part $C_2$ which is in thermal contact with the first heat station 9, lowers and thus the low temperature level maintaining part $C_1$ in the cryostat C is radiantly shielded from the outside.

At the same time, helium gas which is returning from the cryostat C via the J-T circuit 20 is drawn into and compressed by the low stage compressor 21 and is cooled down to a normal temperature of 300 K. with cooling water in the cooling water coil 41. Oil in this cooled down helium is separated by the oil separator 22 and then the helium is drawn into and compressed by the high stage compressor 23. Discharged gas from the compressor 23 is cooled down to the normal temperature 300 K. with cooling water in the cooling water coil 41 around the compressor 23 and after its oil content is separated by the oil separator 24, impurites are adsorbed by the adsorber 25 and clean high pressure helium gas thus obtained is fed to the cyostat C.

High pressure helium gas fed to the cryostat C side enters the primary side of the first J-T heat exchanger 26 undergoes exchange with low pressure helium gas on the secondary side which is returned to the J-T side compressor unit B, is cooled down to about 70 K. from the normal temperature 300 K. and enters in the first precooler 31 at the outer circumference of the first heat station 9 of the expander 6 which has been cooled down to 50–60 K. and there it is cooled down to about 55 K. This cooled down gas enters in the primary side of the second J-T heat exchanger 27 and is cooled down to about 20 K. by undergoing heat exchange with low pressure helium gas on the secondary side which is returned to the J-T side compressor unit B and then enters the second precooler 33 at the outer circumference of the second heat station of the expander 6 which has been cooled down to 15–20 K. and there it is cooled down to about 15 K. Then, gas enters the primary side of the third J-T heat exchanger 28 and is cooled down to about 5 K. by undergoing heat exchange with low pressure helium gas on the secondary side with returns to the J-T side compressor unit B and reaches the J-T valve 36. High pressure helium gas is throttled by the J-T valve 36 and Joule-Thomson expands into a gas/liquid mixed state (1 atm, 4.2 K.) and is fed to the cooler 34. At cooler 34, the latent heat of the evaporation of liquid of the helium in the gas/liquid mixed state is utilized for cooling the photo-detecting sensor S as a substance to be cooled and also for liquefaction and re-condensation of other helium gas.

Then, low pressure helium gas which returns from the cooler 34 to the secondary side of the third J-T heat exchanger 28 turns into saturated gas at about 4.2 K., cools high pressure helium gas on the primary side in the second and the first J-T heat exchangers 27, 26, rises in temperature to about 300 K. and returns to the J-T side compressor unit B. Thereafter, a similar cycle is repeated and the refrigerating operation is carried out.

When measuring is carried out by operating the photo-detecting sensor S, both the compressor 2 and the expander 6 of the precooling refrigerating unit 1 are stopped by the control device 60 and the operation of the precooling refrigerating circuit 1 itself is stopped. During this stoppage of operation, vibration of the expander 6 is not generated and thus vibration imparted to the photo-detecting sensor S can be reduced to a minimum.

Figure 9:
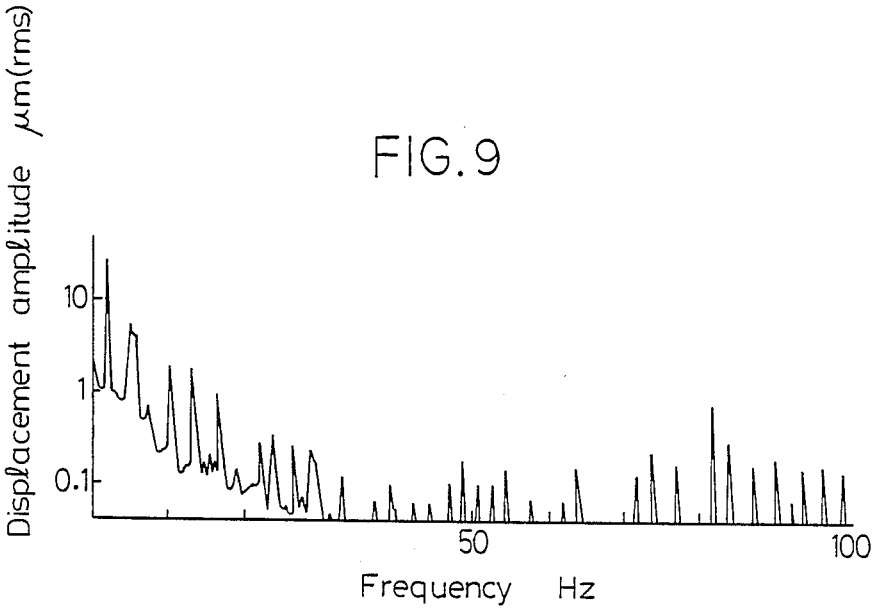
FIG. 9 is a characteristic drawing showing the vibration characteristic of the sensor part, when the precooling refrigerating circuit is working.
Figure 10:
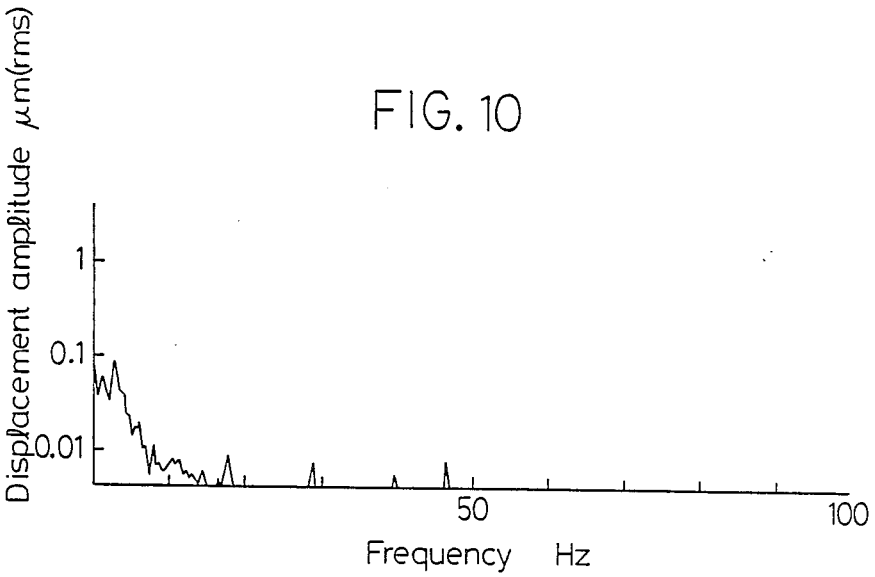
FIG. 10 is a characteristic drawing showing the vibration characteristic of the sensor part while the precooling refrigerating circuit is stopped.

For example, FIG. 10 shows vibration characteristics of the sensor part (cooler 34) when the operation of the precooling refrigerating circuit 1 was stopped. As shown in FIG. 9, as compared with vibration characteristics while the precooling refrigerating circuit is operating, vibration of the sensor part can be reduced to such an extent that it can be disregarded.

When the operation of the precooling refrigerating circuit 1 is stopped, while the first electromagnetic valve 50 is shut, the second electromagnetic valve 52 is opened. Due to this changeover of opening and shutting of both electromagnetic valves 50, 52, the flow of helium gas which was discharged from the compressor 23 of the J-T circuit 20 toward the J-T valve 36 and the cooler 34, via the high pressure side piping 29, is intercepted and high pressure helium gas in the high pressure side piping 29 is bypassed to the low pressure side piping 37, via the bypass piping 51, in the course of which it is decompressed to the pressure of helium gas in the low pressure side piping 37. Accordingly, helium pressure at the cooler 34 which cools the photo-detecting sensor S is kept at the specified pressure, as in the case of the above-described cooling operation, and an abrupt rise in the temperature of the cooler 34 due to a rise in pressure is avoided. Thus, it is possible to keep the photo-detecting sensor S in a very low temperature state thereby enabling its measuring operation to continue for many hours.

Figure 2:
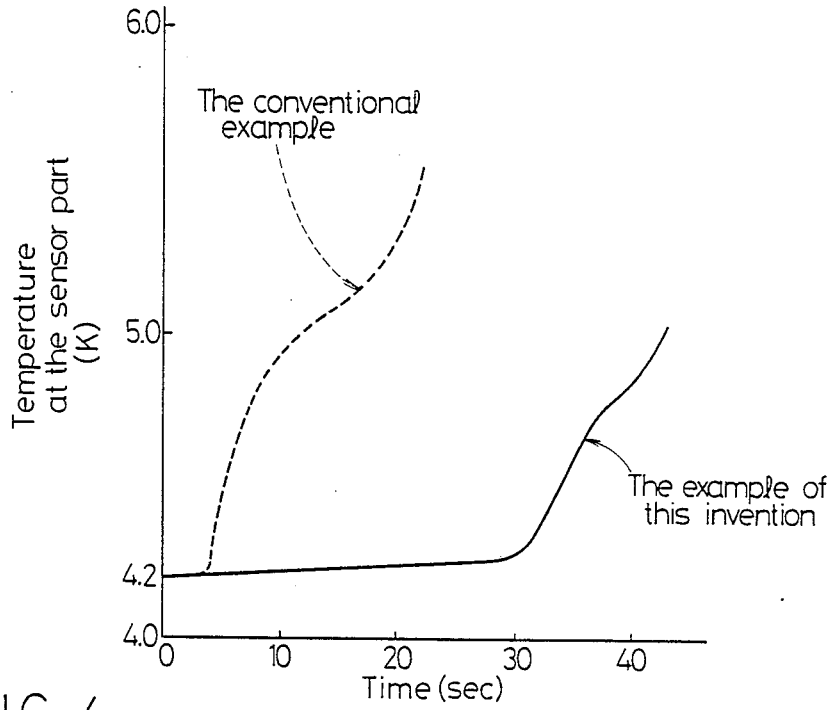

Since a liquid tank 56 is arranged in the piping between the J-T valve 36 and the cooler 34, latent heat of helium liquid can be utilized effectively and a temperature rise of the photo-detecting sensor S can be suppressed for more hours. FIG. 2 shows the degree of temperature rise at the sensor part (cooler 34) after the operation of the precooling refrigerating circuit 1 was stopped as in the present invention in comparison with the conventional case (when the operation of the J-T circuit 20 itself is stopped). From FIG. 2, it can be seen that the present invention can maintain a very low temperature for more hours than can the conventional example.

In the above-described embodiment, the constant pressure regulating valve 54 was used as a pressure regulating means for decompressing helium gas, bypassed from the high pressure side piping 29 to the low pressure side piping 37, to the specified pressure but a flux control valve can be used instead.

Figure 3:
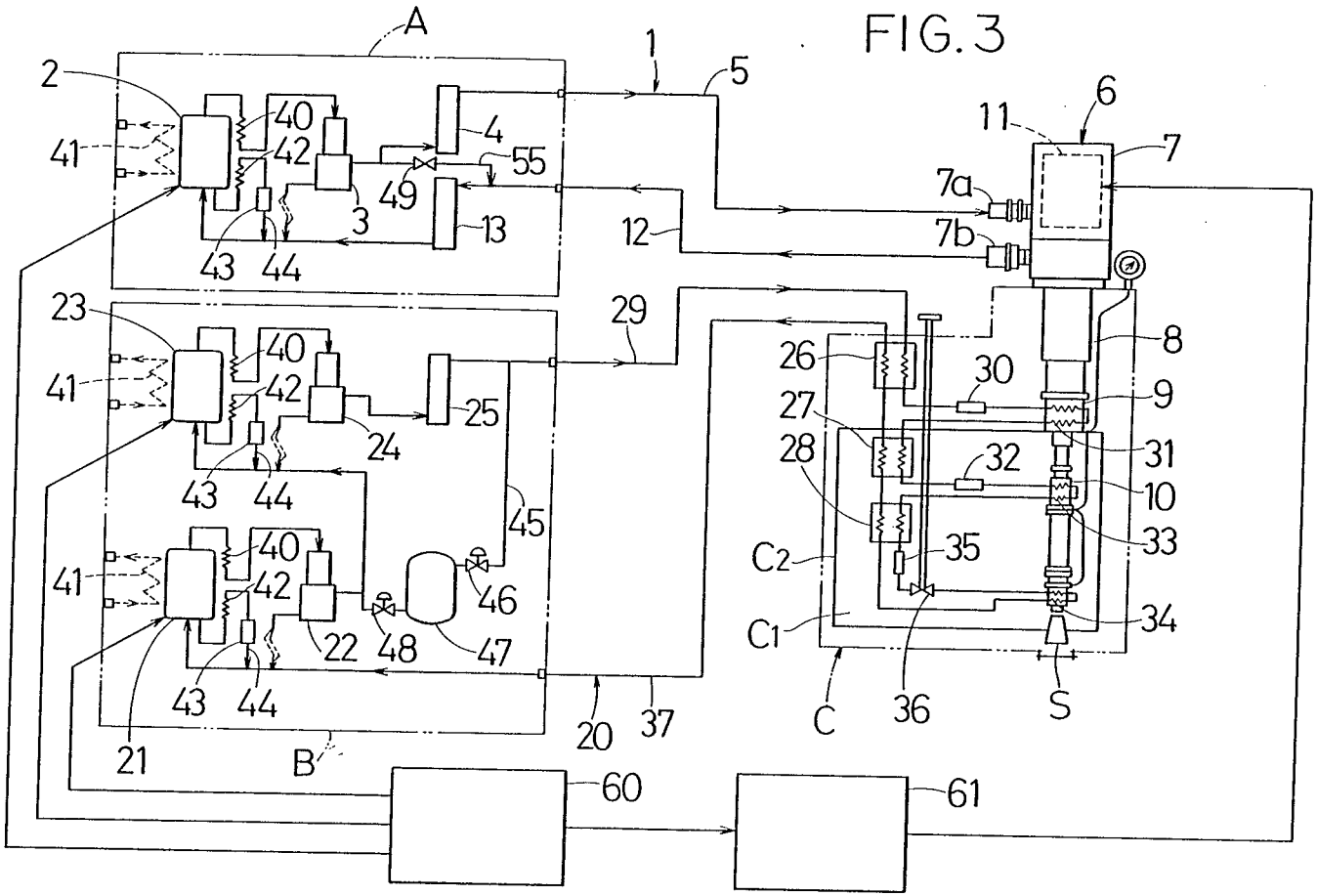

FIG. 3 shows the second embodiment of the present invention. In this embodiment, the bypass means 53 of the first embodiment is omitted. The compressor 2 and the expander 6 of the precooling refrigerating circuit 1 and both compressors 21, 23 of the J-T circuit 20 are controlled by a control device 60. The valve motor 11 of the expander 6 is connected to the control device 60 via a motor working stop device 61 which stops the valve motor 11. The operation of the expander 6 is stopped by the stoppage of the valve motor 11 by the operation of the motor working stop device 61. When the photo-detecting sensor S is operating (when it is measuring), the motor working stop device 61 is controlled by the control device 60 to stop the operation of the expander 6 of the precooling refrigerating circuit 1 and to continue the operation of the J-T circuit 20.

In the precooling refrigerating circuit 1, the piping between the oil separator 3 and the adsorber 4 and the low pressure side piping 12 immediately upstream of the surge bottle 13 are connected to each other by relief piping 55 having an inner relief valve 49. When the operation of the expander 6 is stopped, helium gas from the compressor 2 which does not flow to the expander 6 is decompressed by the inner relief valve 49 and is returned to the compressor 2.

In this embodiment, therefore, when the photodetecting sensor S in the cryostat C is not operating, the motor working stop device 61 is not activated and in this normal state, cooling at the photo-detecting sensor S is carried out. The operation at this time is the same as in the first embodiment.

When the photo-detecting sensor S is operating and measuring various physical quantities, while the of the J-T circuit 20 continues under the control of the control device 60, the motor working stop device 61 is activated and the valve motor 11 of the expander 6 of the precooling refrigerating circuit 1 is stopped, whereby the operation of the expander 6 alone is stopped. Accordingly, vibration of the expander 6 is not generated and vibration imparted to the photo-detecting sensor S can be reduced to the minimum.

Figure 4:
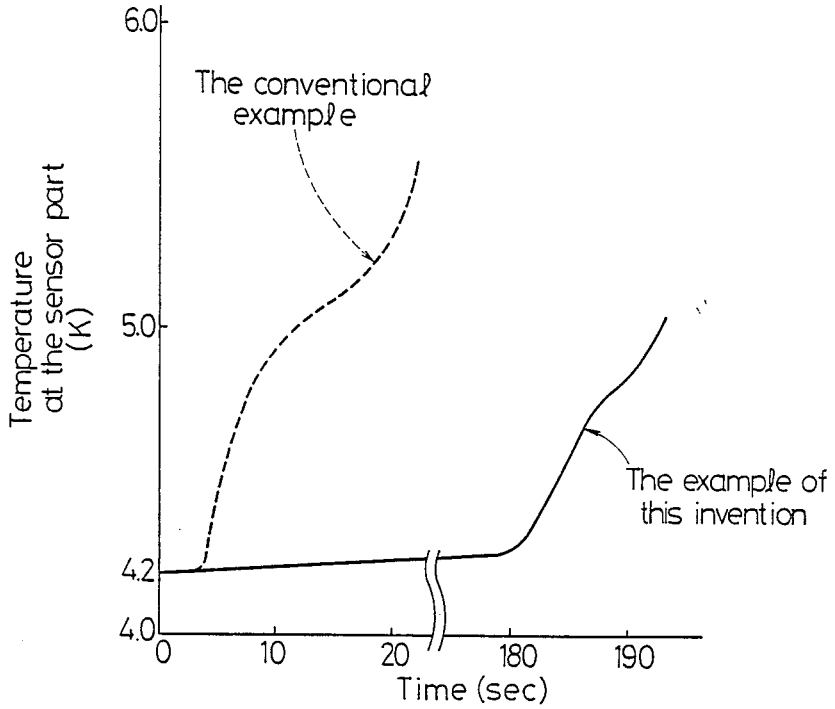

Although the operation of the expander 6 is stopped, heat stations 9, 10 are kept in a very low temperature state and therefore, it is possible to obtain the very low temperature by Joule-Thomson expanding high pressure helium gas from the compressor 23 of the J-T circuit 20, while cooling it at heat stations 9, 10 of the expander 6, the operation of which has been suspended. Thus, the pressure of helium at the cooler 34 which cools the photo-detecting sensor S can be maintained at the specified pressure (1 atm) as in the cooling operation and as shown in FIG. 4, an abrupt temperature rise of the cooler 34 can be avoided for more hours, with the result that the photo-detecting sensor S can be kept in a very low temperature state thereby enabling a stabilized measuring operation to be carried out. FIG. 4 corresponds to FIG. 2 showing characteristics of the first embodiment.

Figure 5:
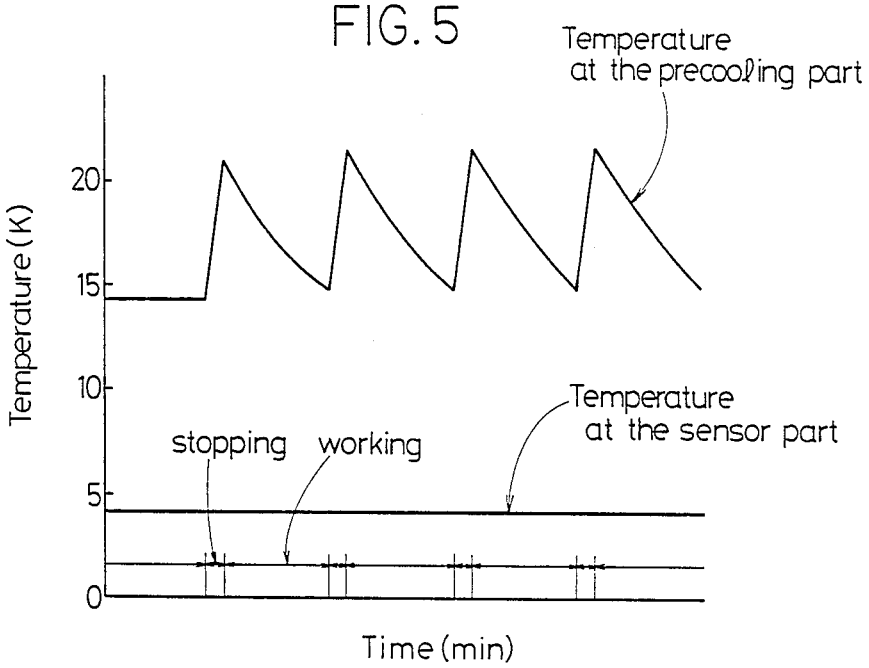
Figure 11:
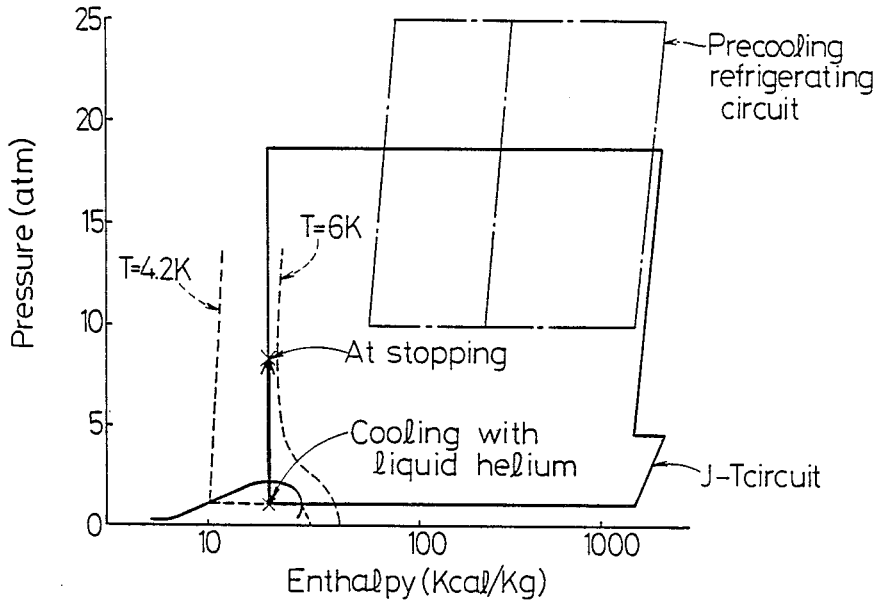
FIG. 11 is a Mollier diagram of the gas cycle in the precooling refrigerating circuit and the J-T circuit of the helium refrigerator.
Figure 6:
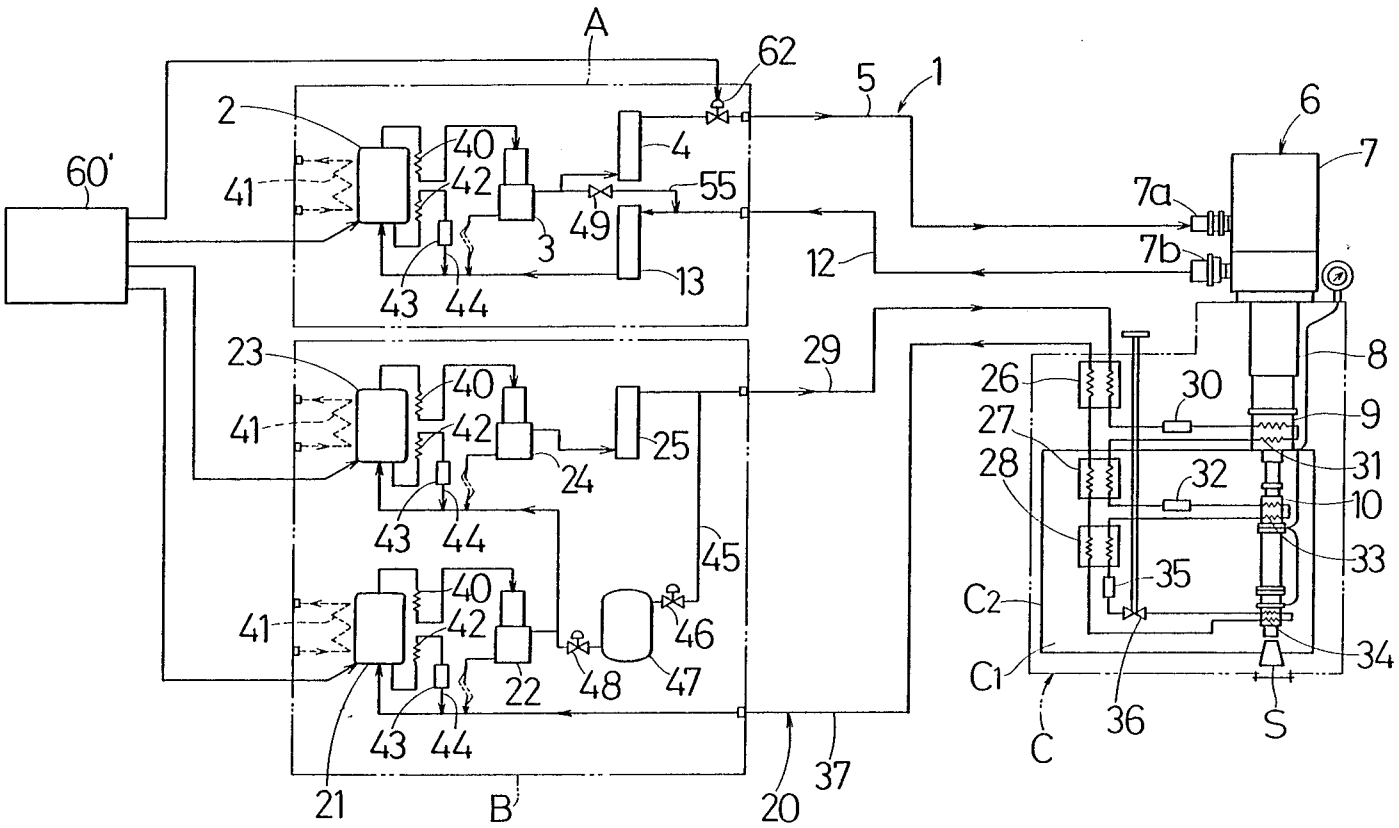

In this embodiment, when cycle of operation in which of the expander 6 is stopped for 2 minutes and then operated for 10 minutes is repeated, for example, as shown in FIG. 5, temperature variations at the precooling part (second heat station 10) of the expander 6 is large but the temperature at the sensor part varies within a range which is smaller than 0.05 K. Therefore, the sensor part can be cooled to and maintained at the very low temperature level. FIG. 6 shows the third embodiment of the present invention. In this third embodiment, an electromagnetic switch valve 62 functioning as an expander stopping means is arranged in the high pressure side piping 5 of the precooling refrigerating circuit 1 for stopping the operation of the expander 6. The operation of the expander 6 is stopped substantially by intercepting the supply of helium gas to the expander 6 by shutting the switch valve 62, under the operation of the control device 60'. Therefore, in this embodiment the same action and effect as in the second embodiment are produced.

As modified examples of this embodiment, the switch valve 62 can be disposed at the low pressure side piping 12 or a switch valve can be arranged at both the high pressure side piping 5 and the low pressure side piping 12. In short, it is essential to stop the supply and discharge of helium gas to and from the expander 6.

Figure 7:
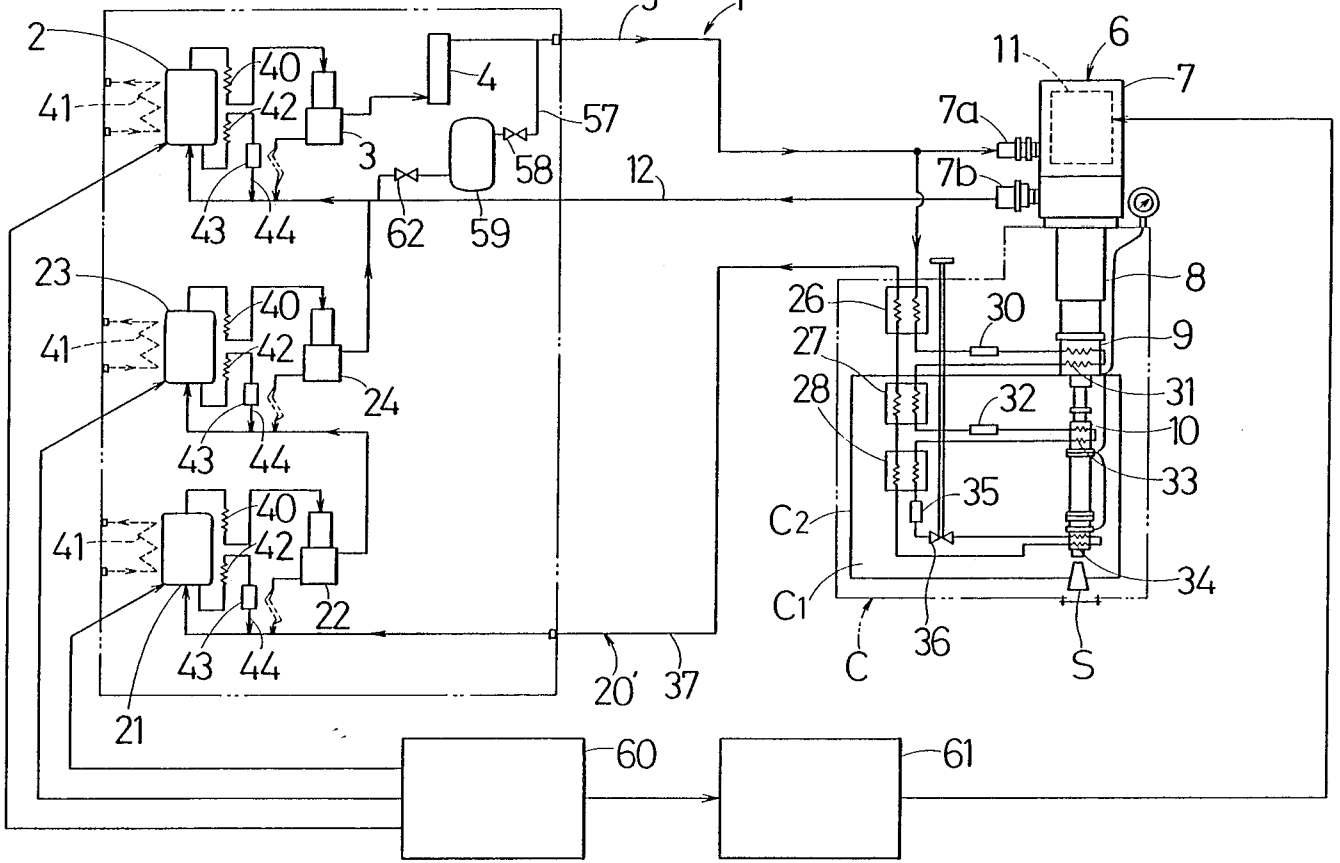

FIG. 7 shows the fourth embodiment of the present invention. It applies to a helium refrigerator having a single circuit. In this embodiment, the oil separator 24 of the J-T circuit 20' and the low pressure side piping 12 of the precooling refrigerating circuit 1' are connected to each other and the high pressure side piping of the J-T circuit 20' is common to the high pressure side piping 5 of the precooling refrigerating circuit 1. The primary side of the first heat exchanger 26 of the J-T circuit 20' is connected to the high pressure side piping 5 of the precooling refrigerating circuit 1'. The connecting pipe 45, gas ballast tank 47, etc. are omitted in the J-T circuit 20' and instead, the high pressure side piping 5 and the low pressure side piping 12 are connected with each other by the connecting pipe 57, to which the high pressure control valve 58, gas ballast tank 59 and the low pressure control valve 62 are arranged in this order from the upstream side. The other elements are the same as in the second embodiment.

Figure 8:
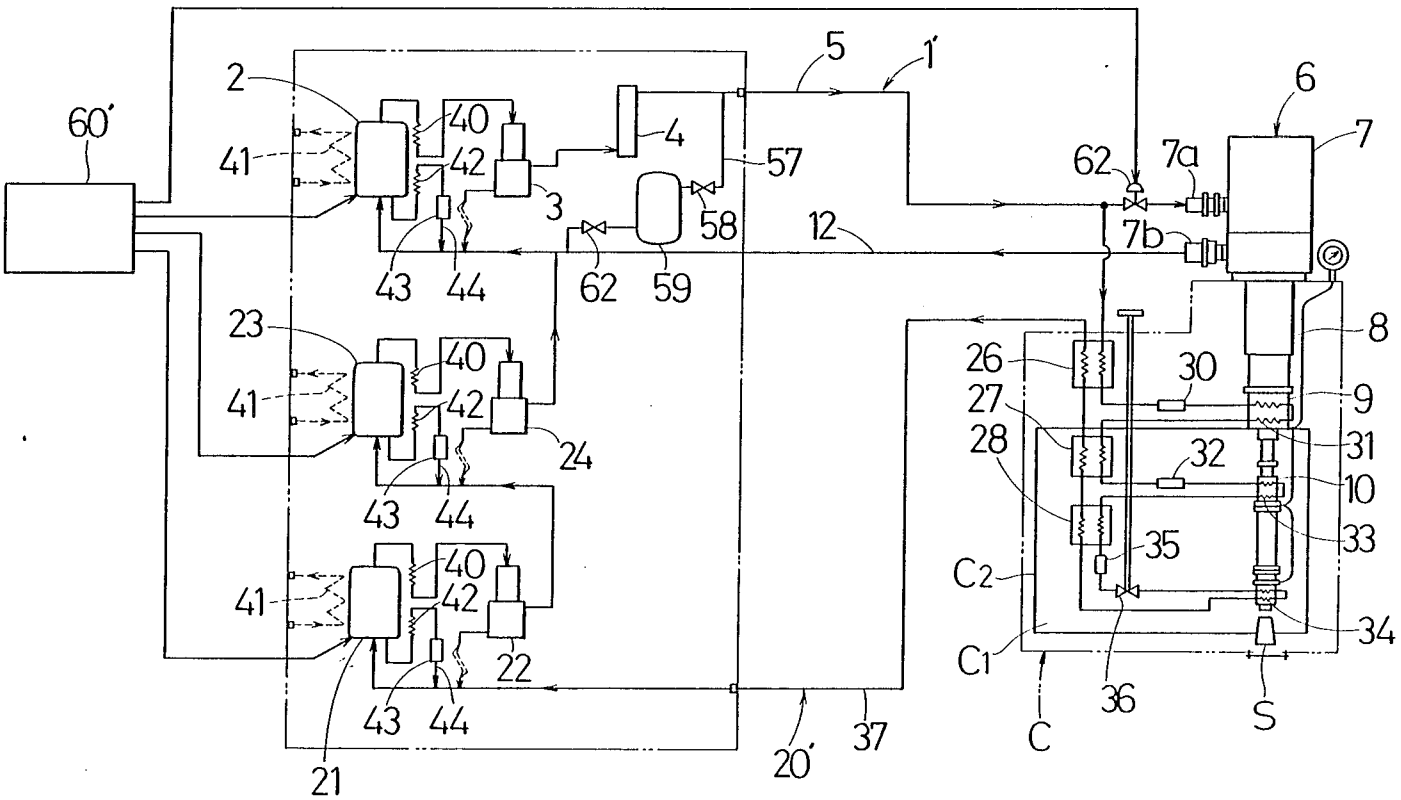

In this embodiment, therefore, about half of the high pressure helium gas discharged from the compressor 2 is supplied to the expander 6, where it is expanded and is returned to the compressor 2 via the low pressure side piping 12. The remaining half of the high pressure helium gas flows into the J-T valve 36 of the J-T circuit 20', where it is Joule-Thomson expanded and is sucked into the compressors 21, 23 via the low pressure side piping 37. After it is compressed by the compressors 21, 23, it is sucked into the compressor 2, together with return helium gas from the expander 6. Thus, in this embodiment, when the photo-detecting sensor S operates, the expander 6 is stopped due to stoppage of the valve motor 11 and therefore, it is possible to keep the sensor part in a very low temperature state for many hours, while reducing vibration imparted to the photo-detecting sensor S, as in the preceding embodiment. FIG. 8 shows the fifth embodiment of the present invention. In order to intercept the supply and discharge of helium gas to and from the expander 6 for the helium refrigerator of having a single circuit as in the fourth embodiment, an electromagnetic switch valve 62 is added as the third embodiment. In this embodiment, the same action and effect as in the preceding embodiments can be produced.

The stoppage of the valve motor 11 of the expander 6 and the stoppage of the supply and discharge of helium gas to and from the expander 6 in each embodiment can be performed together so that such stoppages occur simultaneously.

It is possible to stop the supply of helium gas to the expander 6 and thereby stop the operation of the expander 6 by stopping the operation of the compressor 2 of the precooling refrigerating circuit 1, 1'.

The present invention is applicable not only to the helium refrigerator having a compression cycle as in each embodiment but also to helium refrigerators of other types having a dual circuit and further to a very low temperature refrigerator using refrigerant other than helium.

What is claimed is:

1. A cryogenic refrigerator for maintaining a low temperature working apparatus at a cryogenic level, said cryogenic refrigerator comprising:

a precooling refrigerating circuit including a compressor for compressing refrigerant gas, and an expander operatively connected to said compressor for expanding the gas compressed by said compressor thereby lowering the temperature of the refrigerant gas, said expander including heat stations which are maintained at respective lowered temperatures of the refrigerant gas;

a J-T circuit including a precooler in a heat exchange relationship with the heat stations of said expander for undergoing heat exchange therewith to precool refrigerant gas in the J-T circuit, a J-T valve operatively connected to said precooler for Joule-Thomson expanding the precooled refrigerant gas into a gas/liquid state, and a cooler operatively connected to and downstream of said J-T valve;

a cryostat in which the heat stations of said expander, said J-T valve and said cooler are disposed, said cryostat including a cryogenic maintaining part in which said cooler is disposed for supporting the low temperature working apparatus within said cryostat adjacent said cooler to maintain the low temperature working apparatus at a cryogenic level resulting from evaporation of the liquid of the refrigerant gas existing in a gas/liquid state after the expansion thereof by said J-T valve disposed upstream of said cooler;

a precooling refrigerating circuit stop means operatively connected to said precooling refrigerating circuit and said J-T circuit for stopping the operation of said precooling refrigerating circuit; and a control means operatively connected to said precooling refrigerating circuit stop means for activating said precooling refrigerating circuit stop means to stop the operation of said precooling refrigerating circuit while causing said J-T circuit to operate while the low temperature working apparatus is to be operated.

2. A cryogenic refrigerator as claimed in claim 1, wherein said heat stations consist of two heat stations, and said expander maintains the heat stations at respective cryogenic temperatures of between 50°-60° K. and 15°-20° K. when said precooling refrigerant circuit is operating.

3. A cryogenic refrigerator as claimed in claim 1, wherein said J-T circuit generates a temperature of 4.2° K. at said cooler within said cryogenic maintaining part.

4. A cryogenic refrigerator as claimed in claim 1, wherein said precooling refrigerating circuit operates in one of a Gifford-Mcmahon cycle and a modified Solvay cycle.

5. A cryogenic refrigerator as claimed in claim 1, and further comprising a liquid tank operatively connected between said J-T valve and said cooler for storing the liquid of the refrigerant gas existing in a gas/liquid state.

6. A cryogenic refrigerator as claimed in claim 1, wherein said precooling refrigerating circuit stop means is operatively connected to the expander of said precooling refrigerating circuit for stopping the operation of said expander to stop the operation of said precooling refrigerating circuit.

7. A cryogenic refrigerator as claimed in claim 6, wherein said expander has a valve motor for alternately supplying and discharging refrigerant gas to said expander, and said precooling refrigerating circuit stop means is operatively connected to said valve motor for stopping said valve motor to stop the operation of said expander.

8. A cryogenic refrigerator as claimed in claim 6, wherein said precooling refrigerating circuit stop means includes an electromagnetic switch valve disposed at least at one of two locations, one of said locations being one at which the electromagnetic switch valve is operatively connected in the precooling refrigerating circuit between the discharge side of said compressor and said expander for stopping the supply of refrigerant gas from said compressor to said expander, and the other of said locations being one at which the electromagnetic valve is operatively connected in said precooling refrigerating circuit between said expander and the intake side of said compressor for stopping the discharge of refrigerant gas from said expander to said compressor.

9. A cryogenic refrigerator for maintaining a low temperature working apparatus at a cryogenic level, said cryogenic refrigerator comprising:

a precooling refrigerating circuit including a compressor for compressing refrigerant gas, and an expander operatively connected to said compressor for expanding the gas compressed by said compressor thereby lowering the temperature of the refrigerant gas, said expander including heat stations which are maintained at respective lowered temperatures of the refrigerant gas;

a J-T circuit including a compressor, a precooler operatively connected to and disposed downstream of the compressor of said J-T circuit and disposed in a heat exchange relationship with the heat stations of said expander for undergoing heat exchange therewith to precool refrigerant gas in the J-T circuit, a J-T valve operatively connected to said precooler for Joule-Thomson expanding the precooled refrigerant gas into a gas/liquid state, and a cooler operatively connected to and downstream of said J-T valve;

a cryostat in which the heat stations of said expander, said J-T valve and said cooler are disposed, said cryostat including a cryogenic maintaining part in which said cooler is disposed for supporting the low temperature working apparatus within said cryostat adjacent said cooler to maintain the low temperature working apparatus at a cryogenic level resulting from evaporation of the liquid of the refrigerant gas existing in a gas/liquid state after the expansion thereof of said J-T valve disposed upstream of said cooler;

a bypass means operatively connected to said J-T circuit for opening to pass the supply of refrigerant gas from the discharge side of the compressor of said J-T circuit to the intake side of the compressor of said J-T circuit to bypass said J-T valve;

a pressure regulating means operatively connected to said bypass means for regulating the pressure of refrigerant gas in said bypass means discharged from the compressor of said J-T circuit to the pressure of refrigerant gas flowing to the intake side of the compressor of said J-T circuit; and control means operatively connected to said bypass means and said pressure regulating means for opening said bypass means and operating said pressure regulating means when the low temperature working apparatus is to be operated.

10. A cryogenic refrigerator as claimed in claim 9, wherein said bypass means comprises a first an openable and closable electromagnetic valve operatively connected in said J-T circuit between the discharge side of the compressor of said J-T circuit and said J-T valve for stopping and allowing the flow of refrigerant gas from the compressor of said J-T circuit to said J-T valve when in respective closed and opened position, bypass piping connected to said J-T circuit between a location thereon disposed between the discharge side of the compressor of said J-T circuit and said J-T valve and a location on said J-T circuit disposed between said J-T valve and the intake side of the compressor of said J-T circuit, and a second openable and closable electromagnetic valve operatively connected to said bypass piping for opening and closing said bypass piping when in respective open and closed positions.

11. A cryogenic refrigerator as claims in claim 9, wherein said pressure regulating means is a constant pressure regulating valve.

* * * * *